US008167778B2

(12) United States Patent
Lai

(10) Patent No.: US 8,167,778 B2
(45) Date of Patent: May 1, 2012

(54) TRANSMISSION STRUCTURE OF A WAIST TWIRLING EXERCISE MACHINE FOR BODY-BUILDING

(76) Inventor: Ying-Chou Lai, Huatan Township, Changhua County (TW)

( * ) Notice: Subject to any disclaimer, the term of this patent is extended or adjusted under 35 U.S.C. 154(b) by 0 days.

(21) Appl. No.: 12/463,403

(22) Filed: May 10, 2009

(65) Prior Publication Data

US 2011/0071006 A1 Mar. 24, 2011

(51) Int. Cl.
*A63B 22/14* (2006.01)
*A63B 22/04* (2006.01)

(52) U.S. Cl. ..... 482/51; 482/52; 482/147

(58) Field of Classification Search ..... 482/51–53, 482/70, 79, 112, 146, 147, 71; 434/253
See application file for complete search history.

(56) References Cited

U.S. PATENT DOCUMENTS

| | | | | |
|---|---|---|---|---|
| 5,807,210 | A * | 9/1998 | Devlin | 482/52 |
| 6,709,367 | B1 * | 3/2004 | Liang | 482/53 |
| 6,921,353 | B2 * | 7/2005 | Chuang | 482/52 |
| 6,997,854 | B2 * | 2/2006 | Yang | 482/53 |
| 7,115,073 | B2 * | 10/2006 | Nizamuddin | 482/51 |
| 7,137,928 | B1 * | 11/2006 | Chen | 482/53 |
| 7,591,762 | B2 * | 9/2009 | Chang | 482/52 |
| 7,601,102 | B2 * | 10/2009 | Alessandri et al. | 482/52 |
| 7,780,577 | B2 * | 8/2010 | Arnold | 482/51 |
| 7,878,960 | B1 * | 2/2011 | Liu | 482/146 |
| 2008/0026916 | A1 * | 1/2008 | Chuang et al. | 482/53 |
| 2008/0261777 | A1 * | 10/2008 | Chuang et al. | 482/52 |
| 2008/0312044 | A1 * | 12/2008 | Chen et al. | 482/52 |
| 2011/0071005 | A1 * | 3/2011 | Lai | 482/52 |
| 2011/0071006 | A1 * | 3/2011 | Lai | 482/53 |

FOREIGN PATENT DOCUMENTS

| | | | |
|---|---|---|---|
| CN | 2905125 | Y * | 5/2007 |
| CN | 200954347 | Y * | 10/2007 |
| CN | 101168088 | A * | 4/2008 |

* cited by examiner

*Primary Examiner* — Loan Thanh
*Assistant Examiner* — Victor K Hwang
(74) *Attorney, Agent, or Firm* — Jackson IPG PLLC; Demian K. Jackson

(57) ABSTRACT

A transmission structure of a waist twirling exercise machine for body-building and a method thereof includes left and right stepping rods which are obliquely or horizontally connected to a machine base, left and right stepping platforms having left and right shafts inserting through lubricating members provided in through holes of the left and right stepping rods, left and right transmission members having first ends connected to the left and right shafts and second ends provided with eccentric blocks, left and right connecting rods having first ends connected to the eccentric blocks of the left and right transmission members and second ends pivotally connected to either of the machine base and pneumatic cylinders. When the left and right stepping platforms are treaded in turn, the left and right connecting rods subject to their lengths will drive the left and right stepping platforms to turn left and right in turn synchronously, enhancing a waist twirling effect.

12 Claims, 15 Drawing Sheets

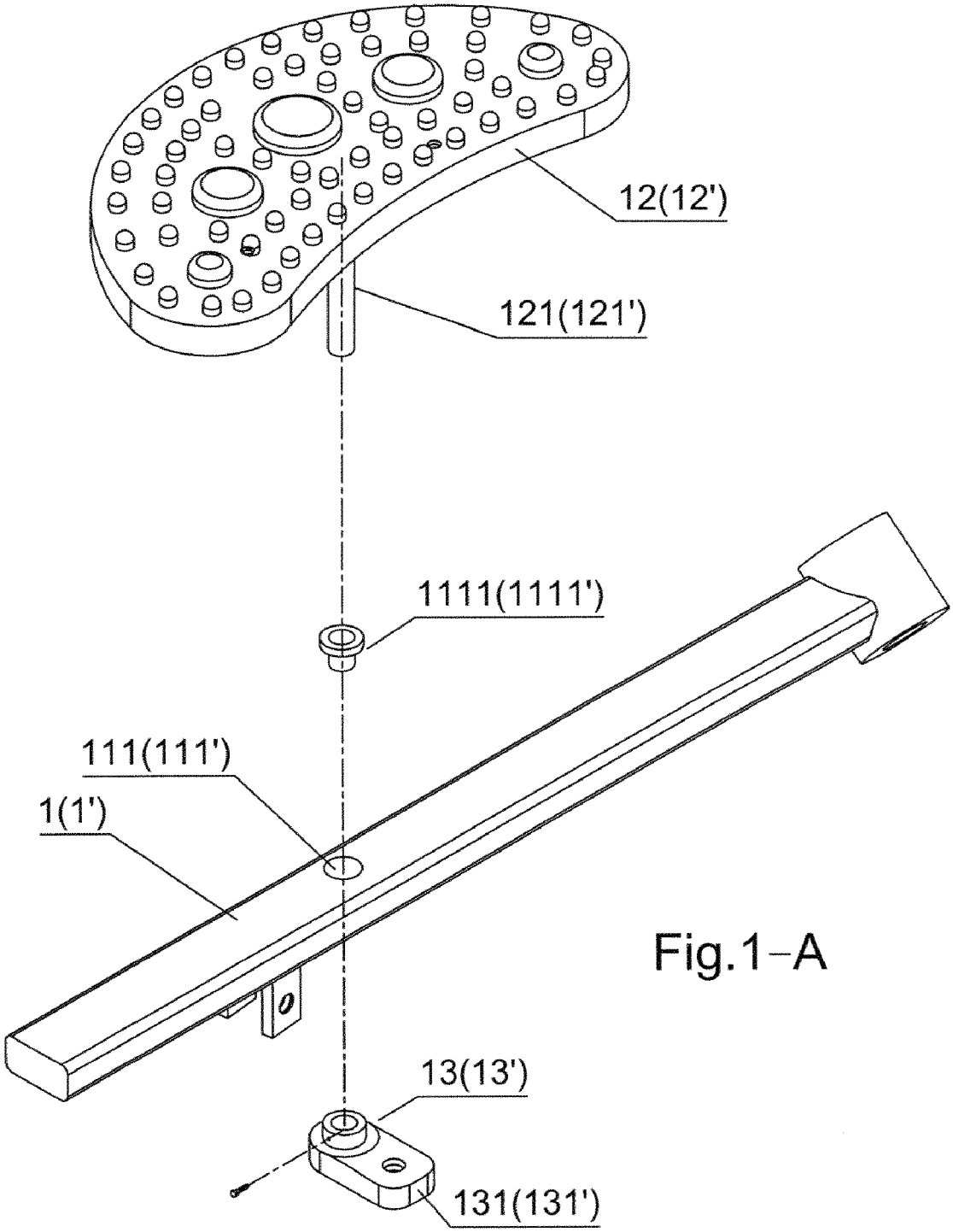
Fig.1-A

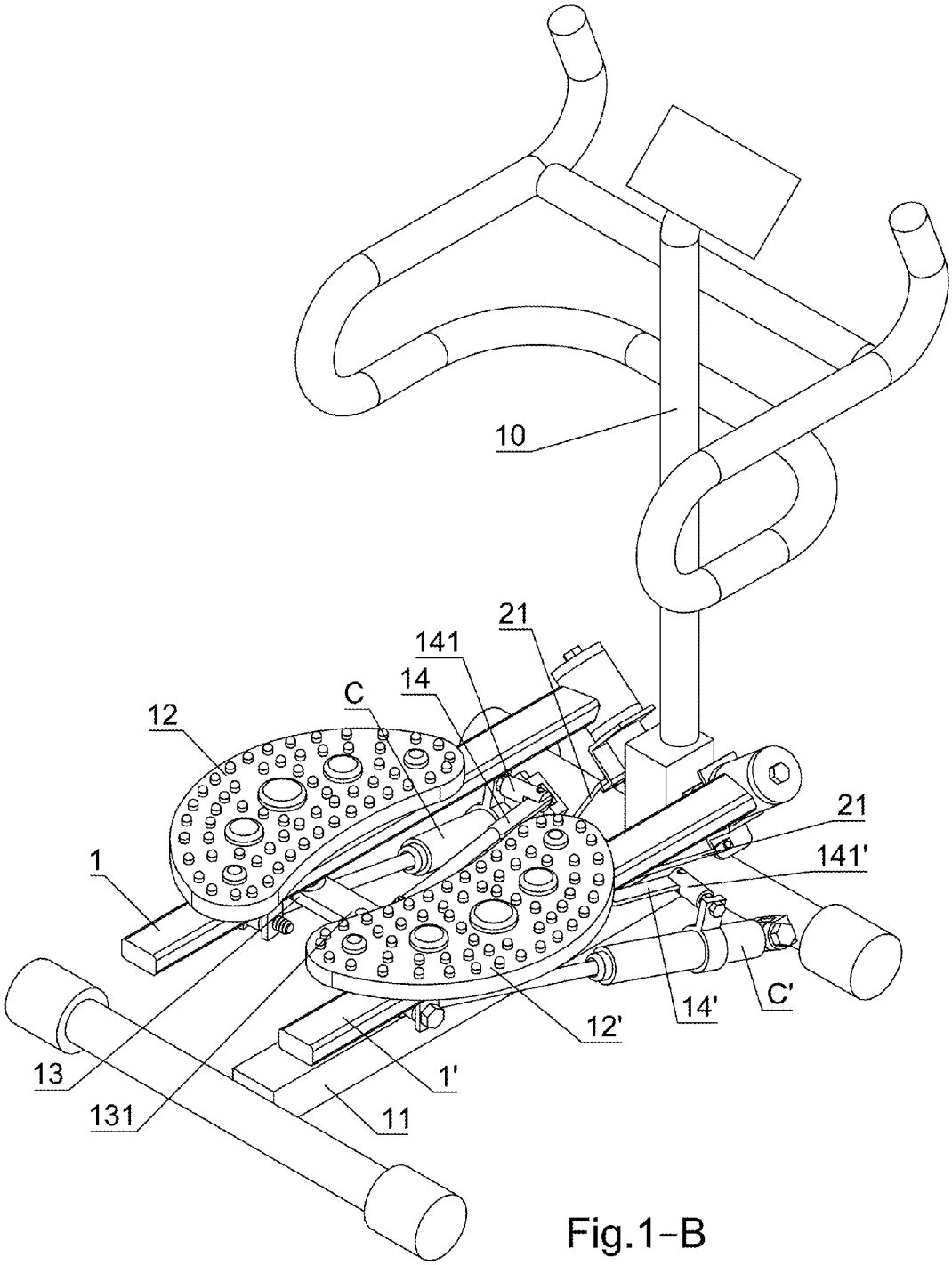
Fig.1-B

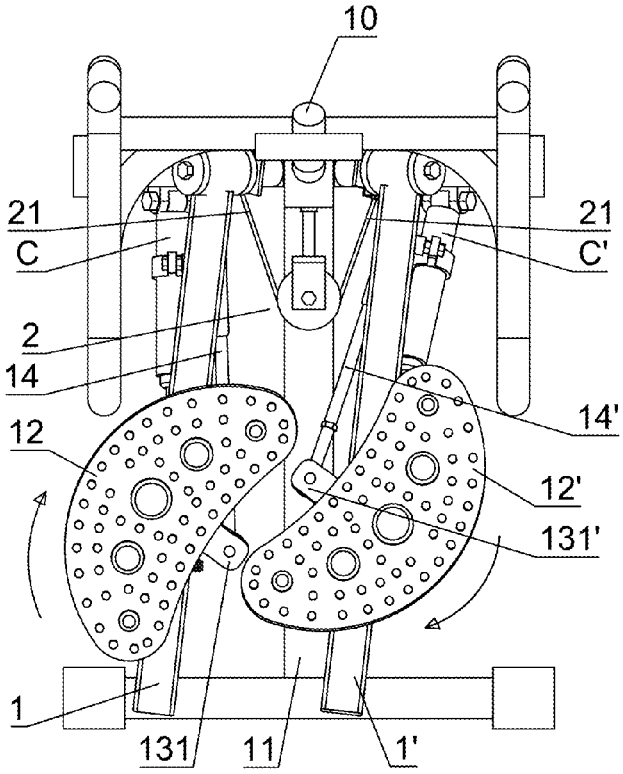
Fig.1-C
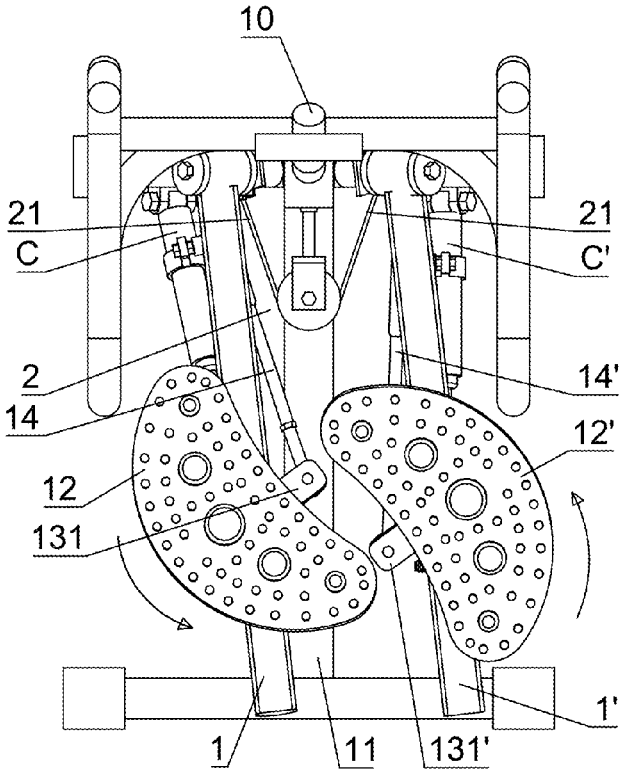
Fig.1-D

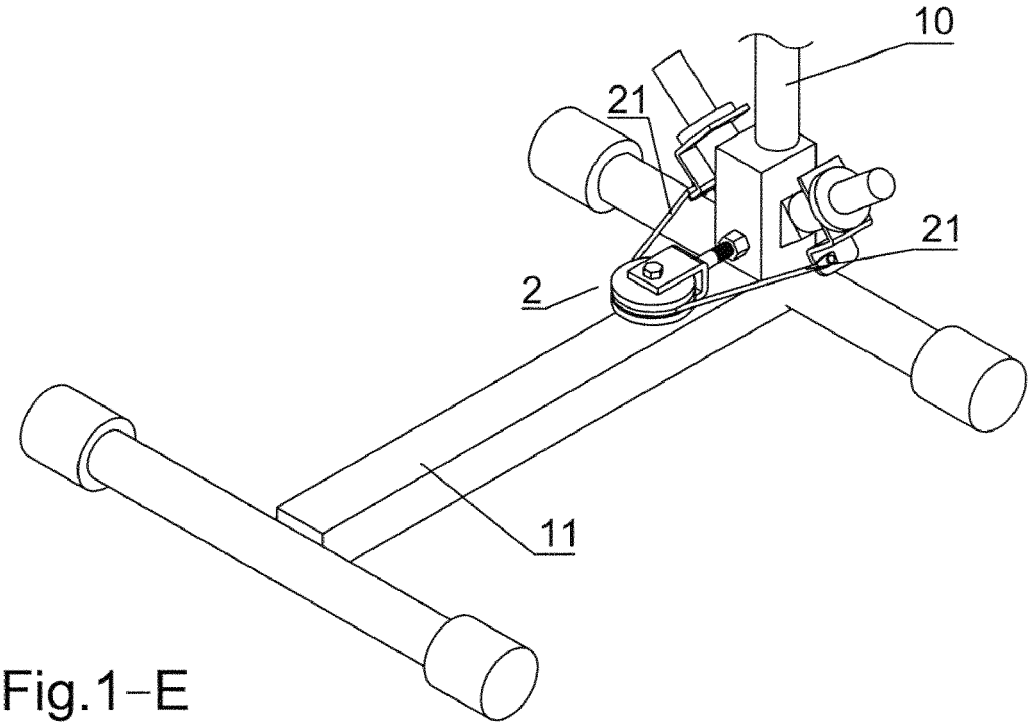
Fig.1-E
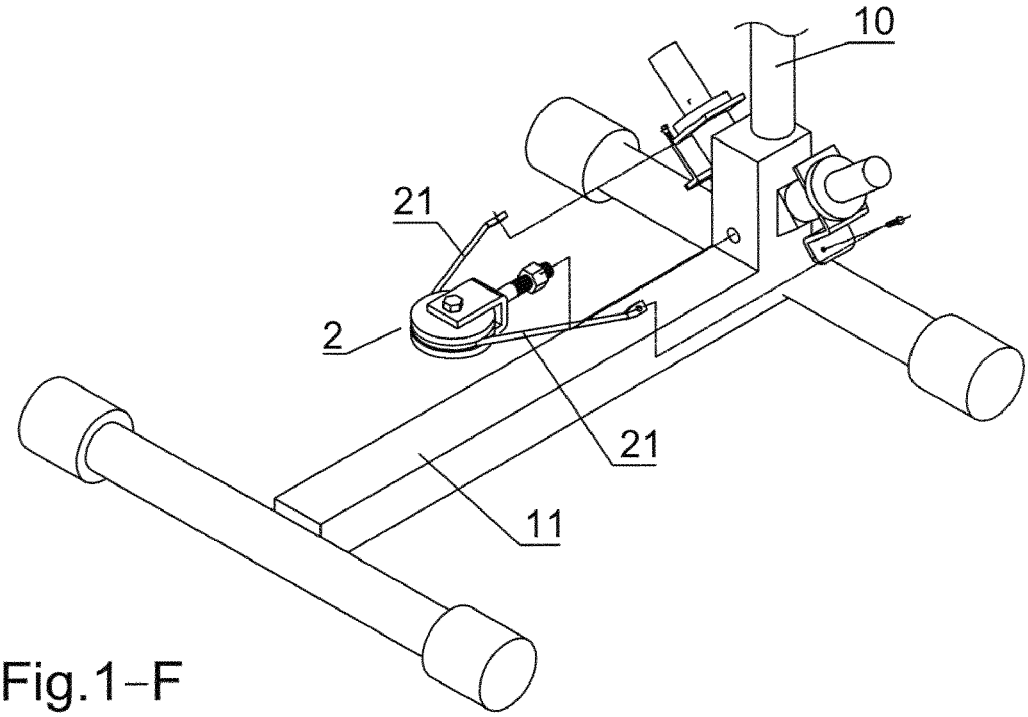
Fig.1-F

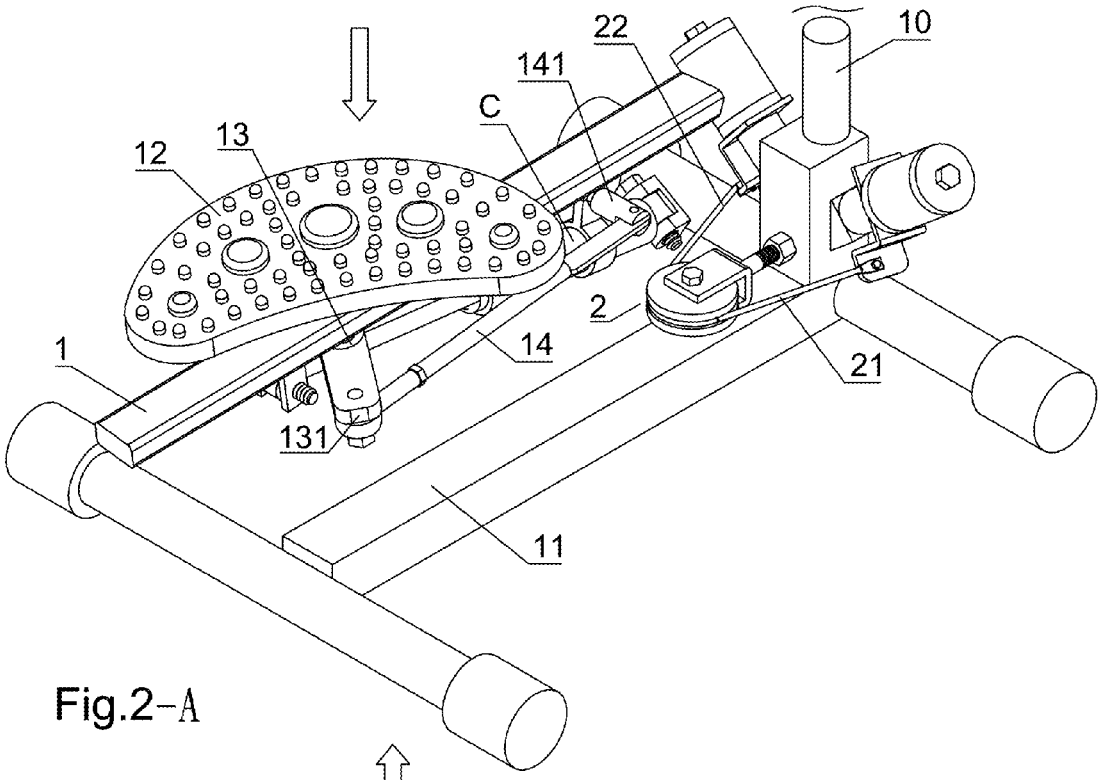
Fig.2-A
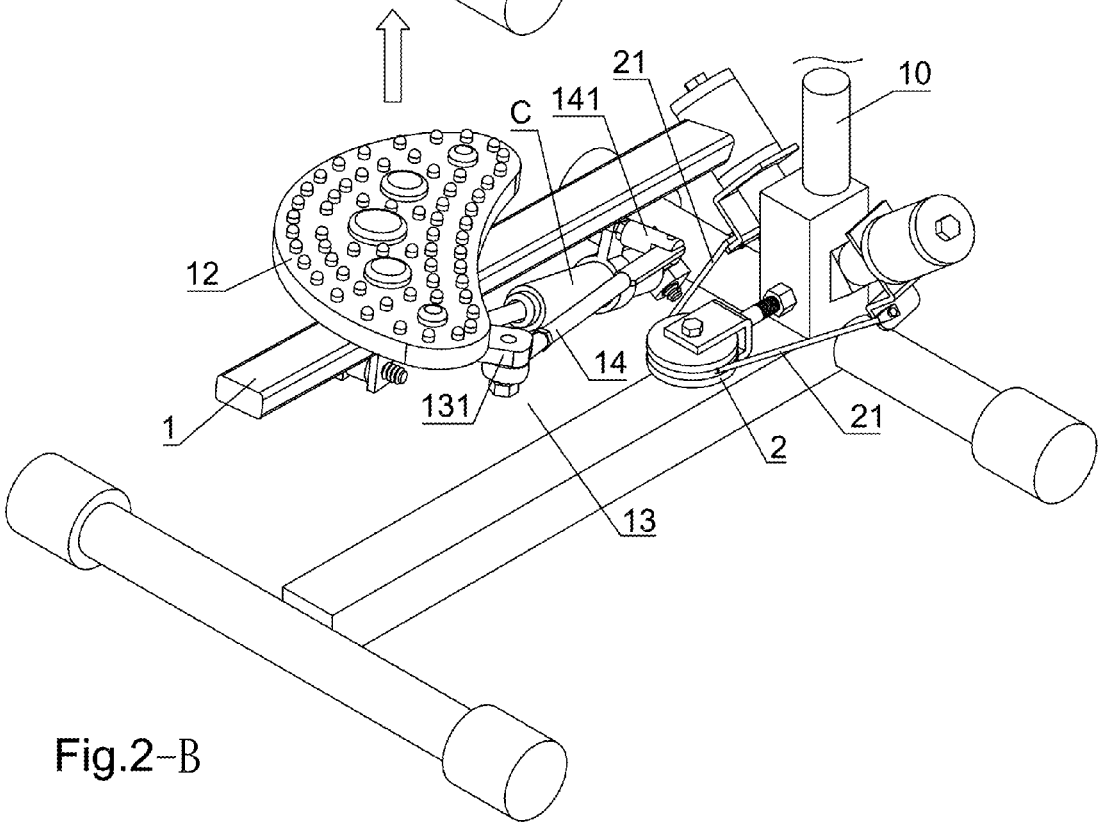
Fig.2-B

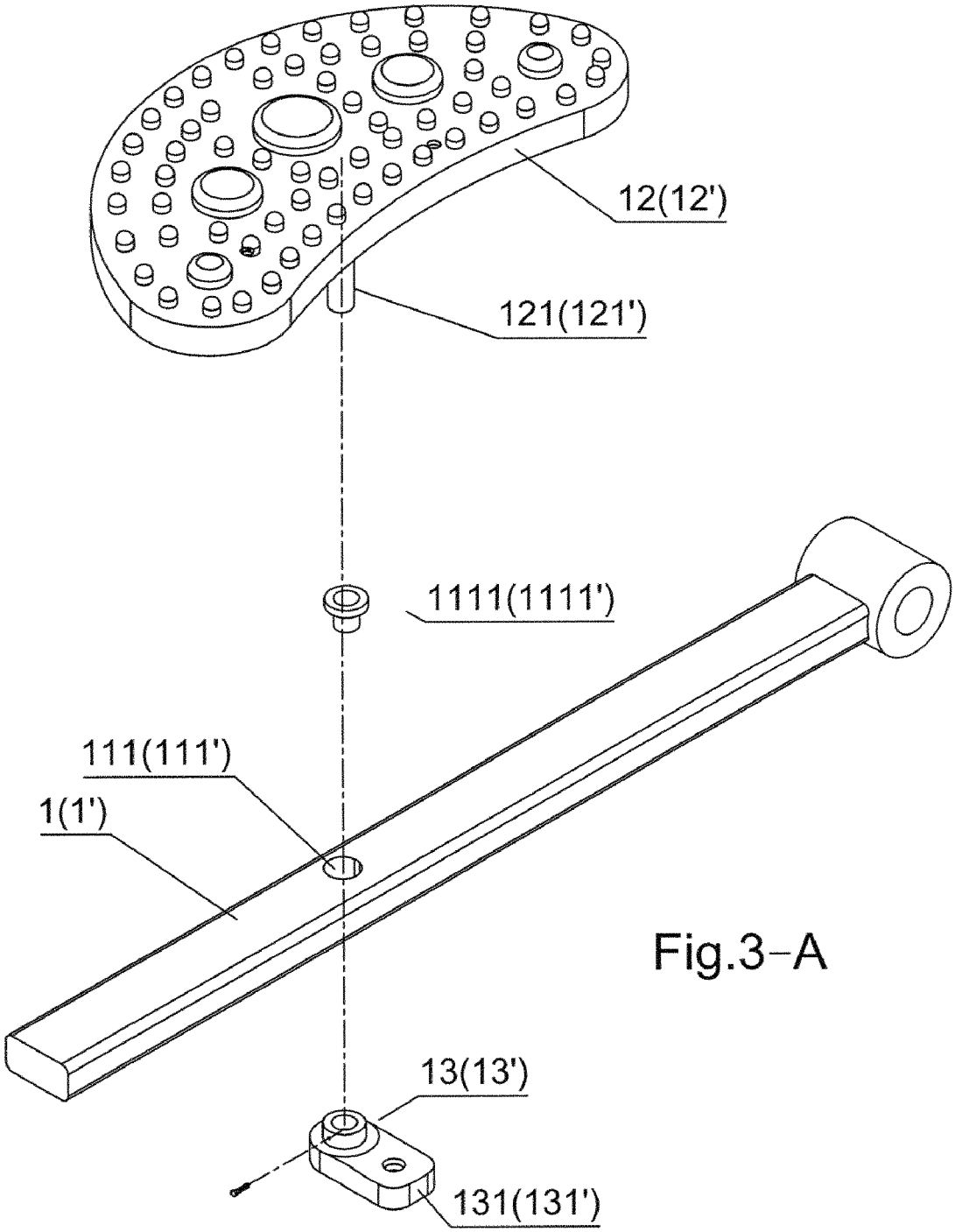
Fig.3-A

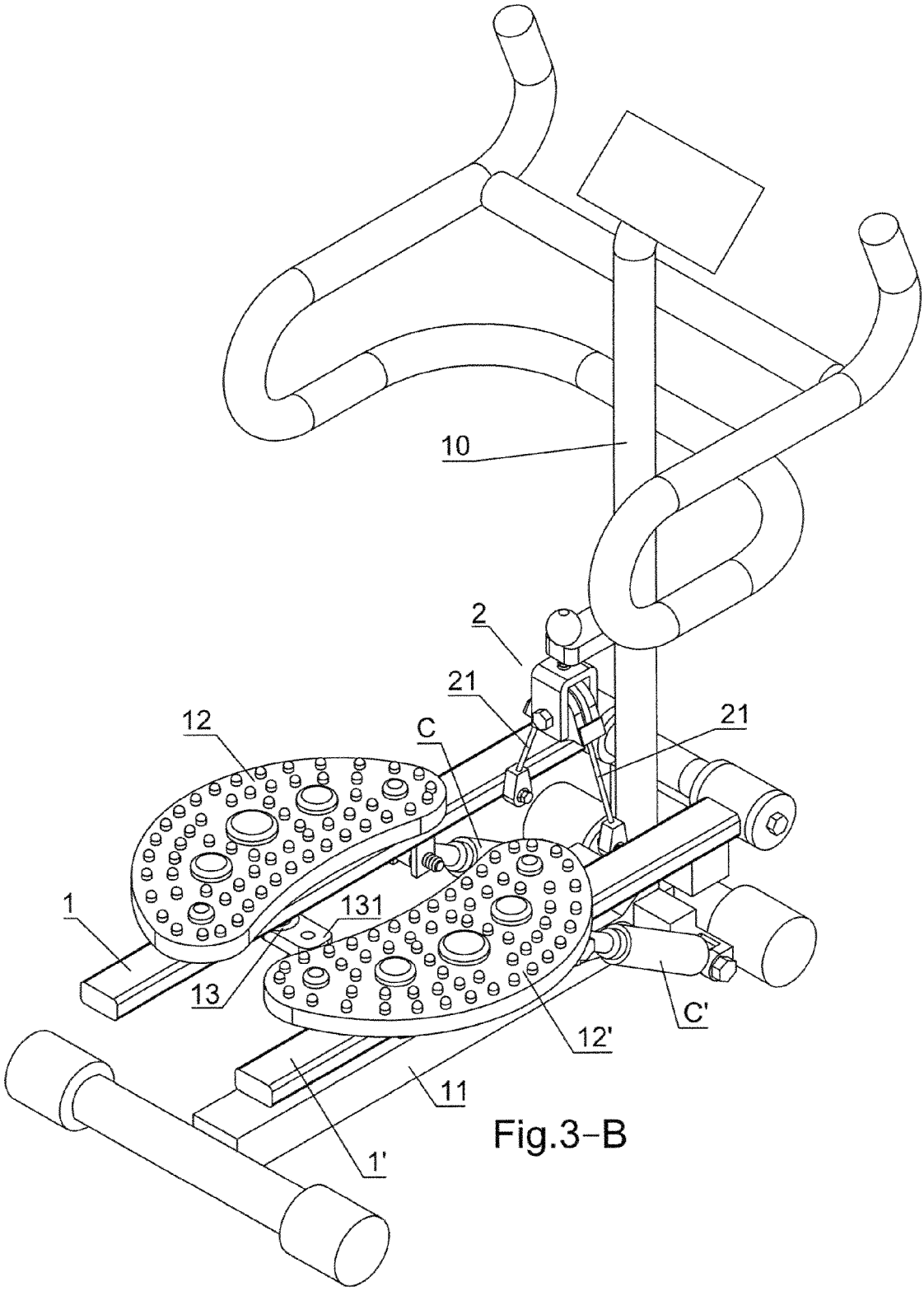
Fig.3-B

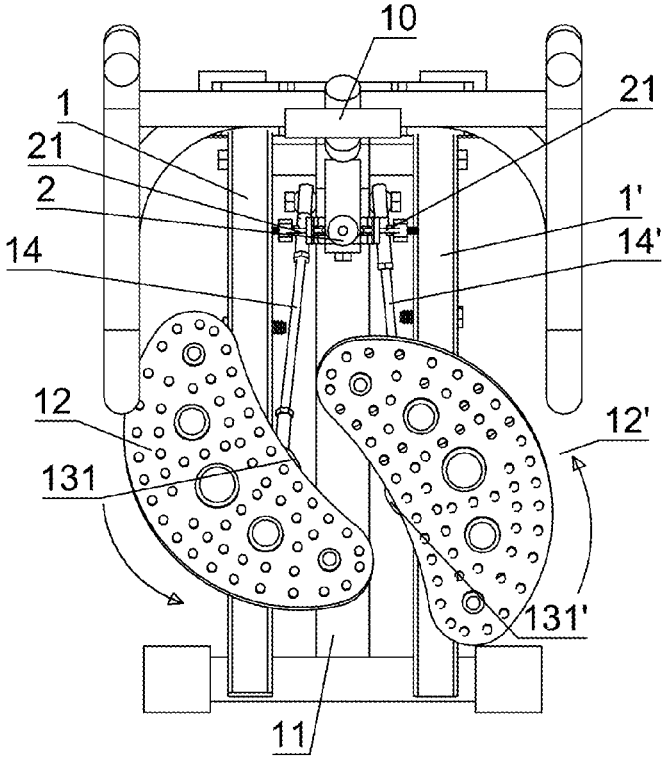
Fig.3-C
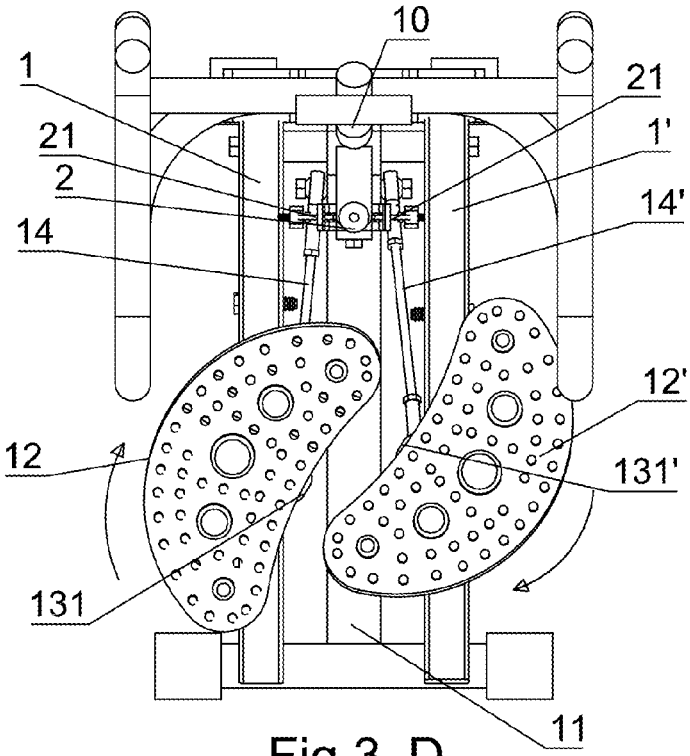
Fig.3-D

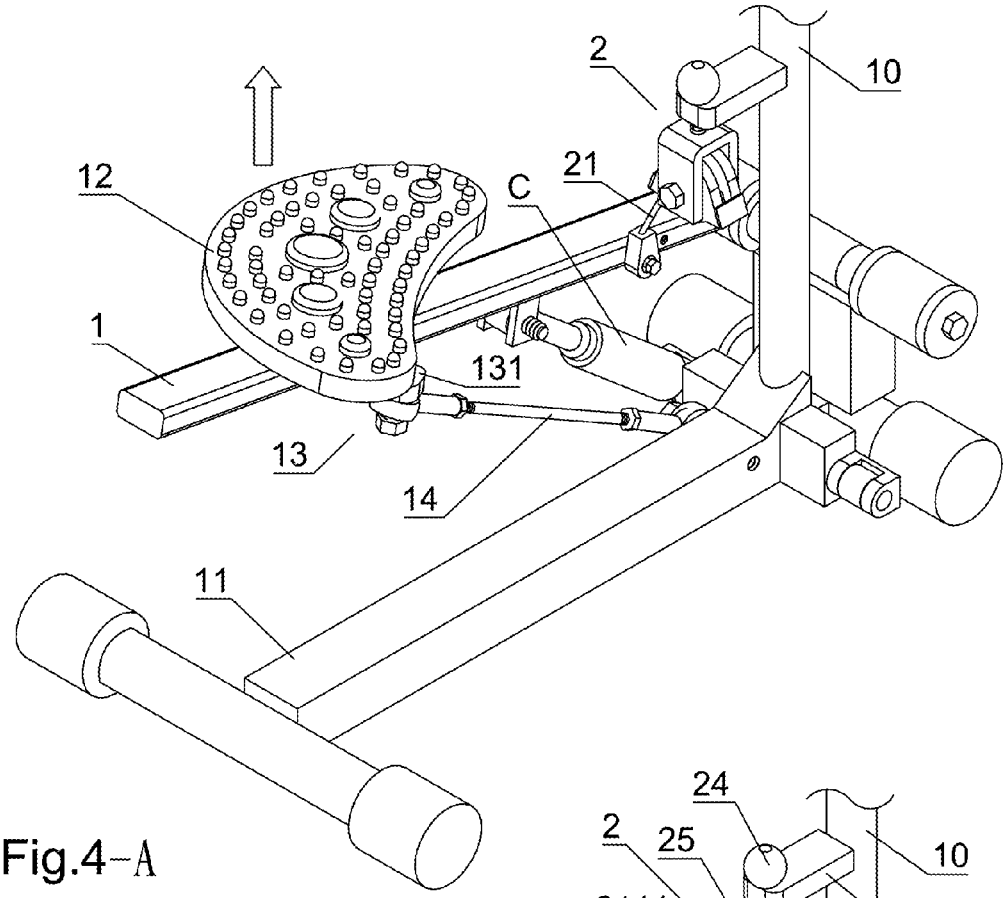
Fig.4-A
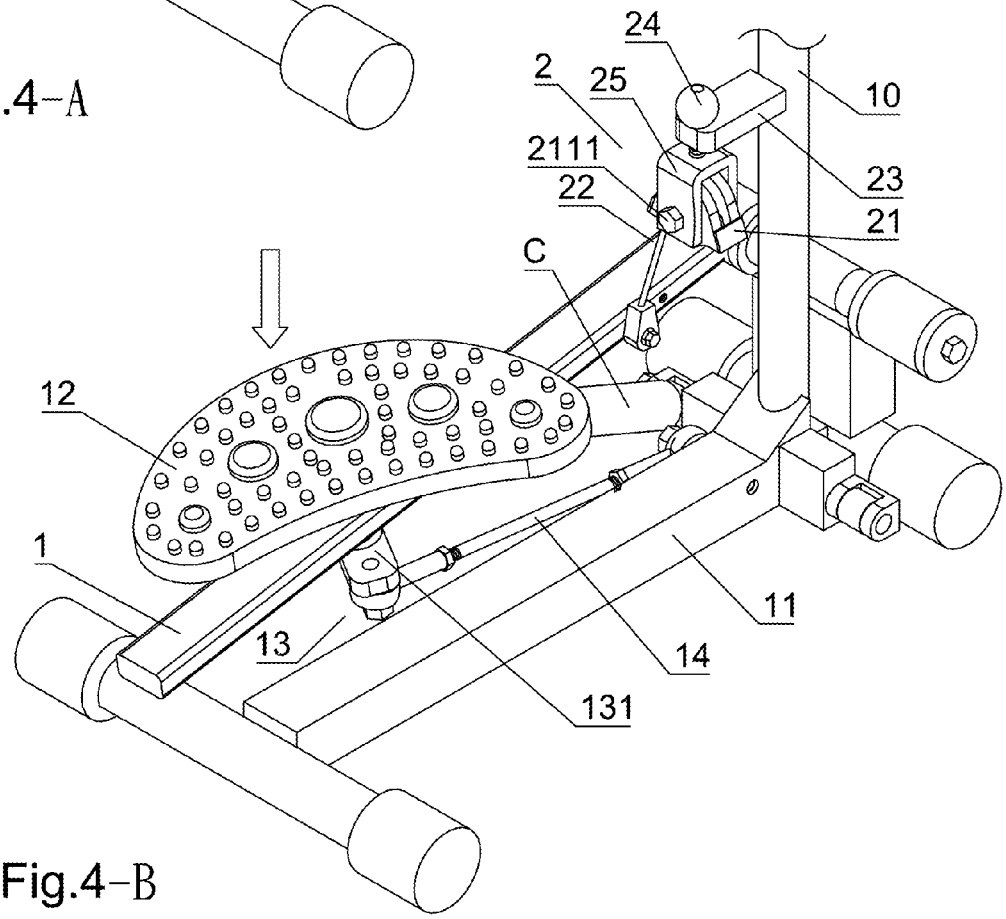
Fig.4-B

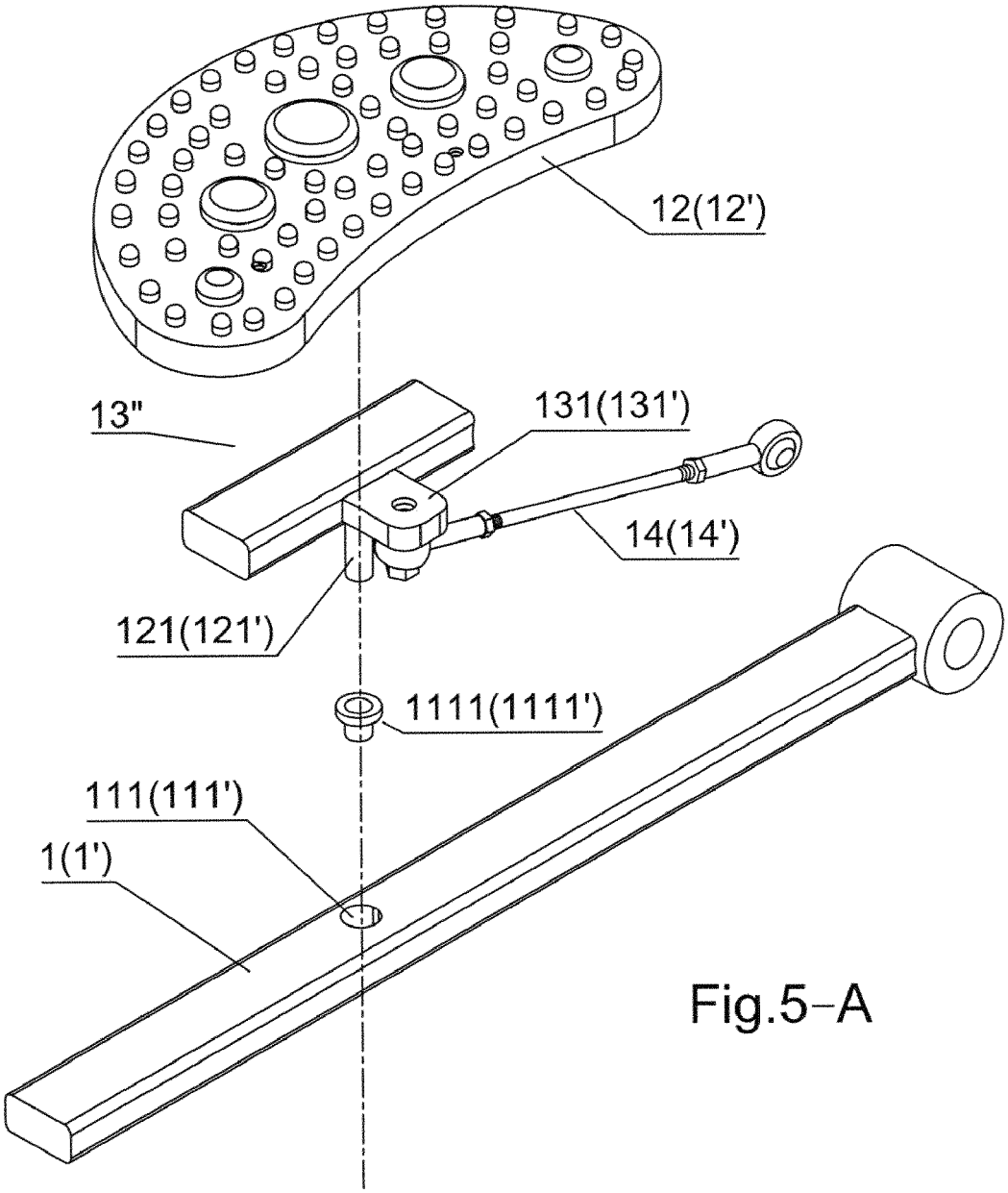
Fig.5-A

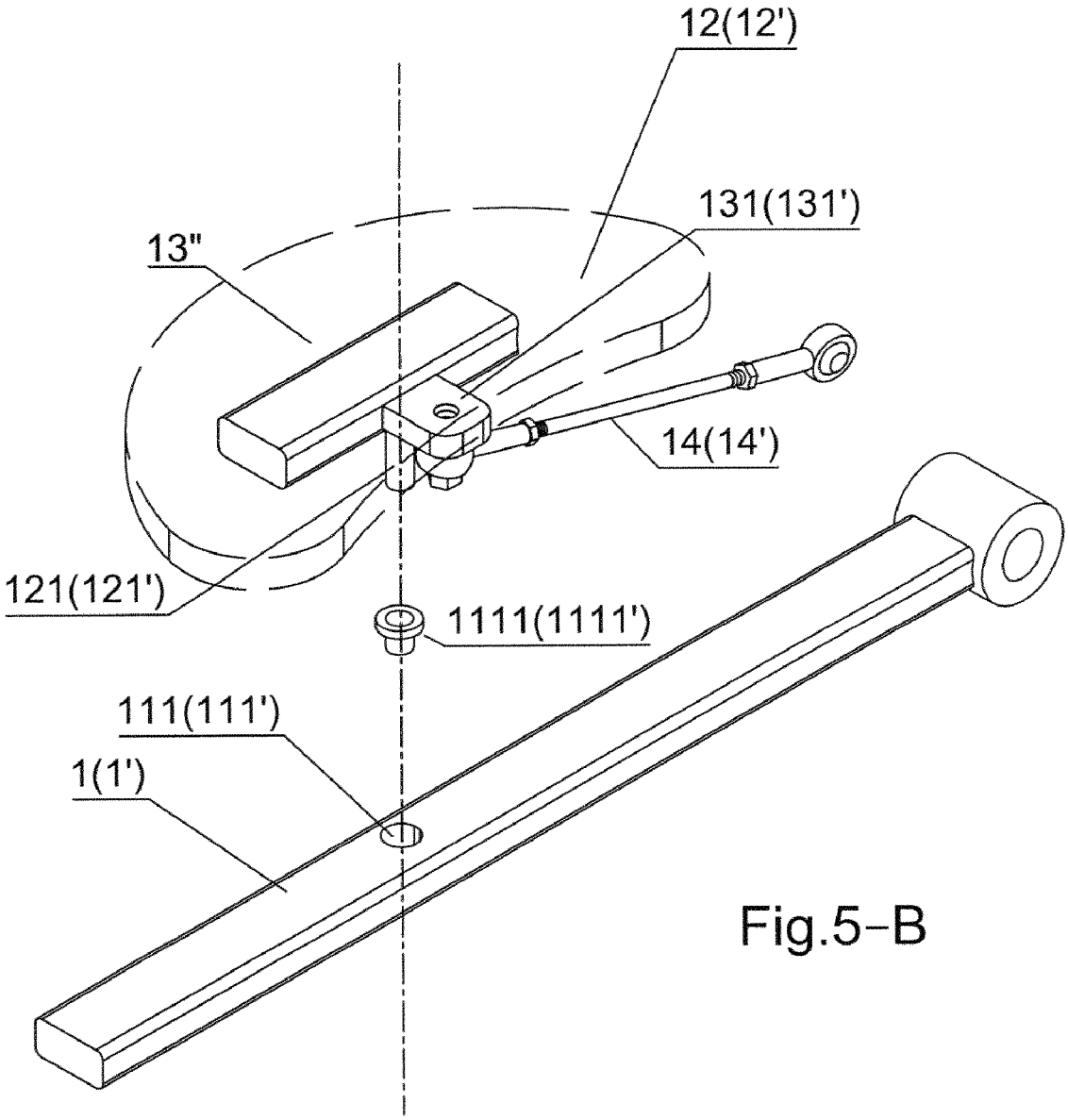
Fig.5-B

TRANSMISSION STRUCTURE OF A WAIST TWIRLING EXERCISE MACHINE FOR BODY-BUILDING

BACKGROUND OF THE INVENTION

1. Field of the Invention

The present invention relates to a transmission structure of a waist twirling exercise machine for body-building and a method thereof, and more particularly to one having left and right stepping platforms for turning left/right synchronously and a linking rope connected to left and right stepping rods for assisting the turning of the left and right platforms, providing stepping exercise and enhancing a waist twirling effect.

2. Description of the Prior Art

A conventional stepping exercise machine is provided with stepping pedals to move stepping rods, by the application of forces during the stepping motion by the user, the applied forces are resisted by pneumatic cylinders. In order to provide a waist twirling effect, a turning axle between the two stepping rods may be biased at a proper angle for waist twirling exercise during the stepping motion. The conventional machine has the following shortcomings.

1. The waist twirling exercise is achieved by the biased angle of the stepping rods, but the twirling angle is limited, which is unable to provide a better waist twirling effect.

2. The range of vertical movement of the stepping pedals is not adjustable for the user's demand.

3. In order to enhance the waist twirling effect, the stepping rods are inclined at a proper angle for providing a biased swing effect when the stepping rods are treaded up and down. However, the twirling motion is not enough, and it is unable to get a twirling motion instead of biased swing.

SUMMARY OF THE INVENTION

According to a first aspect of the present invention, there is provided a transmission structure of a waist twirling exercise machine for body-building comprising left and right stepping rods having first ends obliquely or horizontally connected to two sides of a front end of a machine base, left and right pneumatic cylinders pivotally connected between the left and right stepping rods and the machine base, and a linking mechanism having two ends secured to the left and right stepping rods, the left and right stepping rods compressing the left and right pneumatic cylinders in turn for a damping motion to provide a stepping and swing effect, the transmission structure comprising:

the left and right stepping rods having left and right through holes;

left and right stepping platforms having left and right shafts inserting through the left and right through holes of the left and right stepping rods, the left and right stepping platforms being free to turn on the left and right stepping rods; and thereby, the linking mechanism comprising a linking rope having two ends secured to the left and right stepping rods, when a user treads on the left and right stepping platforms in turn, the left and right stepping platforms being able to turn left or right along with the user's twirling motion to enhance a waist twirling effect.

According to a second aspect of the present invention, there is provided a transmission structure of a waist twirling exercise machine for body-building comprising left and right pneumatic cylinders pivotally connected between left and right stepping rods and a machine base and a linking mechanism having two ends secured to the left and right stepping rods, the left and right stepping rods compressing the left and right pneumatic cylinders in turn for a damping motion to provide a mutual synchronous twirling effect, the transmission structure comprising:

the left and right stepping rods being obliquely connected to two sides of a front end of a machine base and having left and right through holes for insertion of left and right lubricating members, left and right stepping platforms having left and right shafts inserting through the left and right lubricating members and the left and right through holes of the left and right stepping rods, left and right transmission members having first ends connected to the left and right shafts and second ends provided with eccentric blocks;

left and right connecting rods having first ends connected to the eccentric blocks of the left and right transmission members and second ends pivotally connected to the left and right pneumatic cylinders;

thereby, when the right stepping platform is treaded, the right connecting rod subject to its length pushing the right transmission member to turn counterclockwise, the right stepping platform being driven to turn counterclockwise synchronously, meanwhile, the left stepping platform driving the left stepping rod to rise by means of the linking rope when the right stepping rod is treaded, the left connecting rod subject to its length pushing the left transmission member to turn counterclockwise, the left stepping platform being driven to turn counterclockwise synchronously, on the contrary, when the left stepping platform is treaded, the left connecting rod subject to its length pushing the left transmission member to turn clockwise, the left stepping platform being driven to turn clockwise synchronously, meanwhile, the right stepping platform driving the right stepping rod to rise by means of the linking rope when the left stepping rod is treaded, the right connecting rod subject to its length pushing the right transmission member to turn clockwise, the right stepping platform being driven to turn clockwise synchronously, when the left and right stepping platforms are treaded in turn, the left and right stepping platforms being driven to turn clockwise or counterclockwise in turn for enhancing a waist twirling effect.

According to a third aspect of the present invention, there is provided a transmission structure of a waist twirling exercise machine for body-building comprising left and right stepping rods, left and right transmission members and, left and right connecting rods, and a linking mechanism:

the left and right stepping rods being horizontally connected to two sides of a front section of a machine base and having left and right through holes for insertion of left and right lubricating members, left and right stepping platforms having left and right shafts inserting through the left and right lubricating members and the left and right through holes of the left and right stepping rods, the left and right transmission members having first ends connected to the left and right shafts and second ends provided with eccentric blocks;

the left and right connecting rods having first ends connected to the eccentric blocks of the left and right transmission members and second ends pivotally connected to the two sides of the front section of the machine base;

thereby, the left and right connecting rods having the first ends connected with the left and right transmission members under the left and right stepping rods and the second ends secured to the two sides of the front section of the machine base, the left and right transmission members being pivotally connected to the left and right stepping rods for the left and right stepping platforms to drive the left and right connecting rods to move and for the left and right transmission members to turn at the same angle as well as the left and right stepping platforms to turn synchronously at the same angle.

BRIEF DESCRIPTION OF THE DRAWINGS

FIG. 1-A is an exploded view showing a stepping platform and a transmission member of the present invention;

FIG. 1-B is a perspective view of the first preferred embodiment of the present invention;

FIGS. 1-C and 1-D are top views of the first preferred embodiment of the present invention in an operating status;

FIG. 1-E is a perspective view of a linking mechanism of the present invention;

FIG. 1-F is an exploded view of the linking mechanism of the present invention;

FIGS. 2-A and 2-B are schematic views showing a left stepping platform in a treaded status;

FIG. 3-A is an exploded view showing a stepping platform and a transmission member of the present invention;

FIG. 3-B is a rear perspective view of the second preferred embodiment of the present invention;

FIGS. 3-C and 3-D are top views of the second preferred embodiment of the present invention in an operating status;

FIGS. 4-A and 4-B are schematic views showing a left stepping platform in a treaded status;

FIG. 5-A is a perspective view showing another embodiment of the transmission member of the present invention; and FIG. 5-B is a partially enlarged view of FIG. 5-A.

DETAILED DESCRIPTION OF THE PREFERRED EMBODIMENTS

Figure 1:
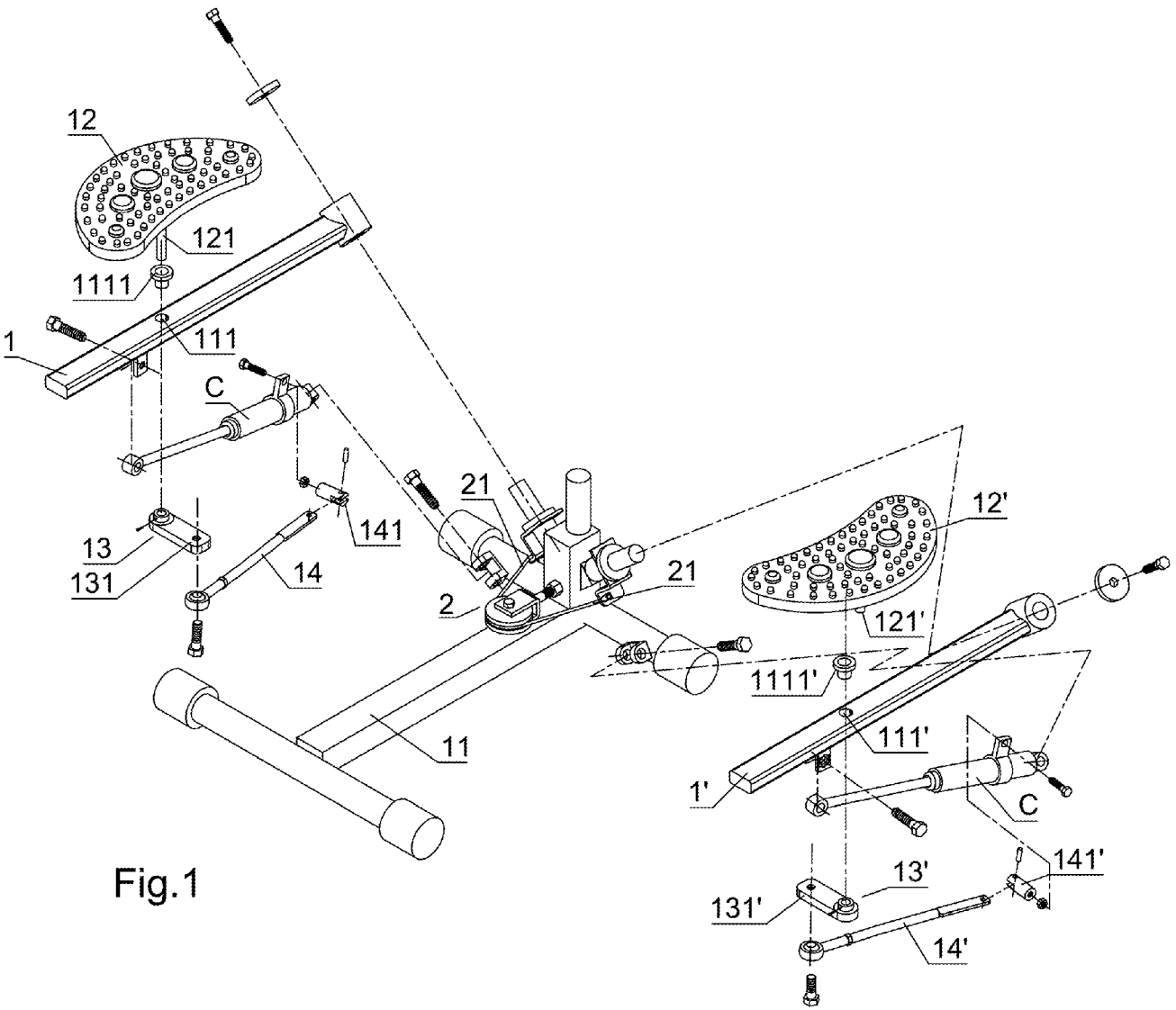
FIG. 1 is an exploded view of a first preferred embodiment of the present invention.
Figure 3:
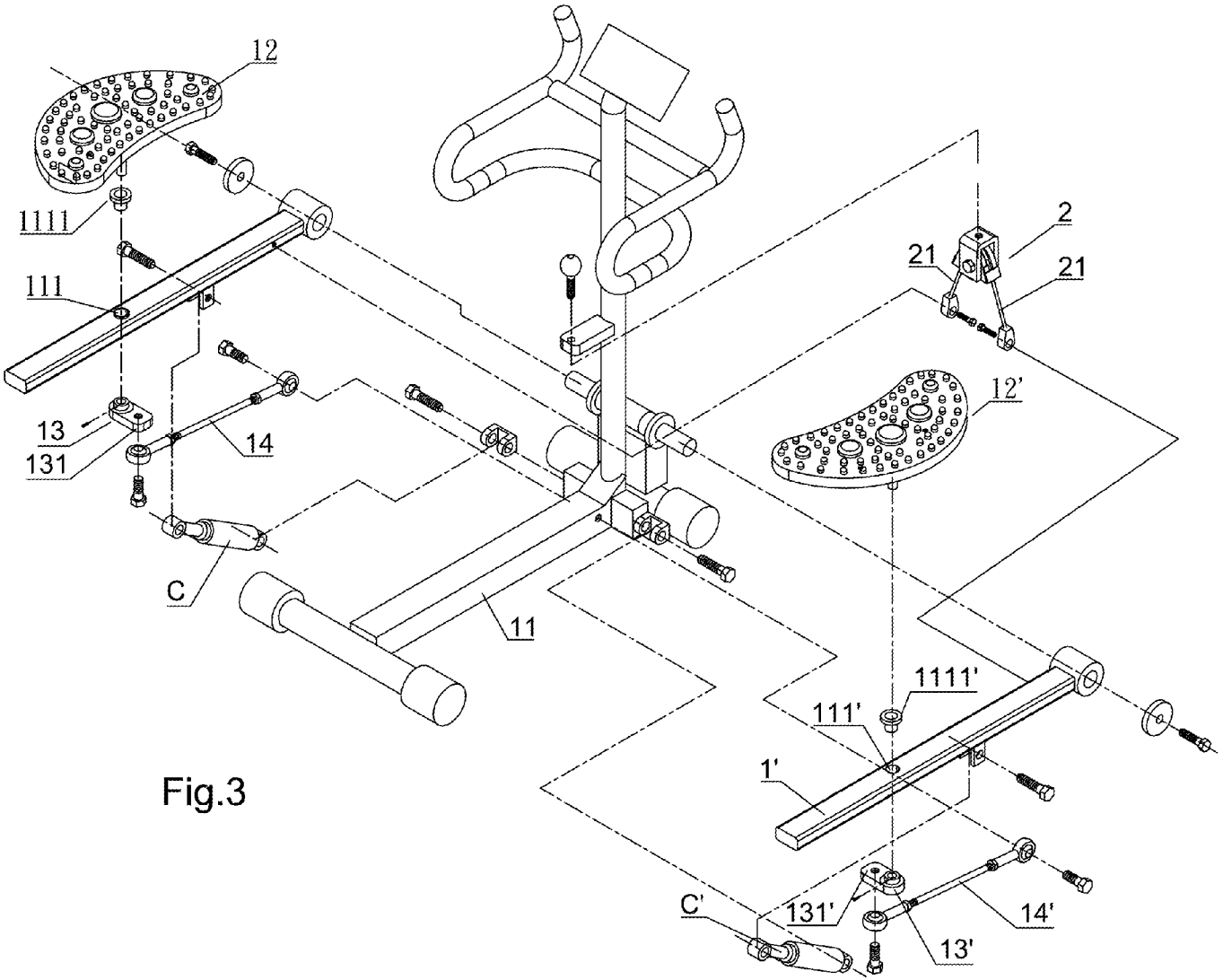
FIG. 3 is an exploded view of a second preferred embodiment of the present invention.

As shown in FIG. 1, FIGS. 1-A and 1-B, FIG. 3, FIGS. 3-A and 3-B, left and right stepping rods 1 and 1' have left and right through holes 111 and 111' for insertion of left and right lubricating members 1111 and 1111'. The left and right lubricating members 1111 and 1111' may be sleeves or bearings. Left and right stepping platforms 12 and 12' are provided with left and right shaft 121 and 121' to be inserted into the left and right lubricating members 1111 and 1111'. Lower ends of the left and right lubricating members 1111 and 1111' are secured to first ends of left and right transmission members 13 and 13'. The left and right transmission members 13 and 13' have second ends provided with eccentric blocks 131 and 131' which are pivotally connected with first ends of left and right connecting rods 14 and 14', respectively. The left and right connecting rods 14 and 14 have second ends pivotally connected to a machine base or pneumatic cylinders. The first ends and second ends of the left and right connecting rods 14 and 14 may be universal joints, universal bearings or hinges. When the left and right stepping platforms 12 and 12' are treaded in turn, the left and right transmission members 13 and 13' will be pulled to turn left or right synchronously by the left and right connecting rods 14 and 14 for providing stepping and waist twirling exercise.

Referring to FIGS. 1-E and 1-F, a frame 10 is provided with a linking mechanism 2. The linking mechanism 2 includes a linking rope 21 having two ends secured to the left and right stepping rods 1 and 1', respectively. The foresaid structure is in conjunction with the damping of left and right pneumatic cylinders C and C' to achieve stepping exercise as well as waist twirling exercise.

Figure 2:
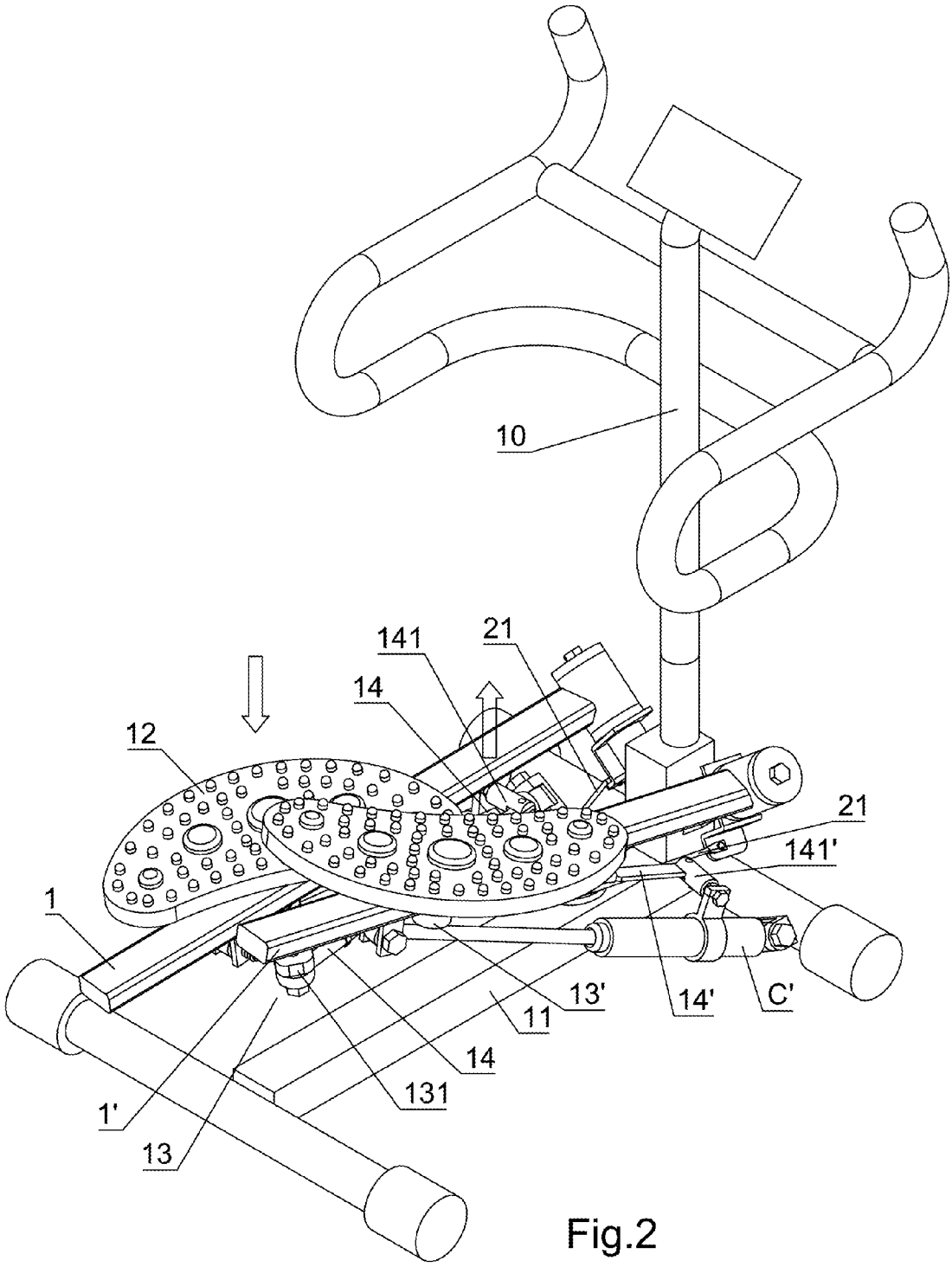
FIG. 2 is a perspective view of the first preferred embodiment of the present invention in an operating status.

As shown FIG. 1 and FIG. 2, first ends of the left and right stepping rods 1 and 1' are obliquely or horizontally connected to two sides of a front end of a machine base 11. The pneumatic cylinders C and C' are disposed between the left and right stepping rods 1 and 1' and the machine base 11. The linking rope 21 has the two ends secured to the left and right stepping rods 1 and 1'. The left and right stepping rods 1 and 1' compress the left and right pneumatic cylinders C and C' in turn for a damping effect to provide a stepping and twirling effect. The transmission structure comprises the left and right stepping rods 1 and 1' and the left and right stepping platforms 12 and 12'.

The left and right stepping rods 1 and 1' have the left and right through holes 111 and 111' for insertion of the left and right lubricating members 1111 and 1111'. The left and right stepping platforms 12 and 12' have the left and right shafts 121 and 121' inserting through the left and right lubricating members 1111 and 1111' of the left and right stepping rods 1 and 1' so that the left and right stepping platforms 12 and 12' are free to turn on the left and right stepping rods 1 and 1'.

When the user treads on the left and right stepping rods 1 and 1' in turn and twirls the left and right stepping platforms 12 and 12' back and forth, the left and right stepping platforms 12 and 12' are able to turn left or right along with the user's twirling motion to provide a waist twirling exercise.

FIG. 1 and FIGS. 1-A through 1-F show another embodiment of the present invention, the pneumatic cylinders C and C' are disposed between the left and right stepping rods 1 and 1' and the machine base 11. The left and right stepping rods 1 and 1' compress the left and right pneumatic cylinders C and C' in turn for a damping effect. The stepping and waist twirling transmission structure comprises the left and right stepping rods 1 and 1', the left and right stepping platforms 12 and 12', the left and right transmission members 13 and 13', and the left and right connecting rods 14 an 14'.

The left and right stepping rods 1 and 1' are obliquely connected to two sides of a front end of the machine base 11. The left and right stepping rods 1 and 1' have the left and right through holes 111 and 111' for insertion of the left and right lubricating members 1111 and 1111'. The left and right stepping platforms 12 and 12' are provided with the left and right shafts 121 and 121' inserting through the left and right through holes 111 and 111'.

The left and right transmission members 13 and 13' have the first ends connected with the left and right shafts 121 and 121' and the second ends provided with the eccentric blocks 131 and 131' which are pivotally connected with the first ends of the left and right connecting rods 14 and 14' respectively, for controlling the turning direction of the left and right stepping platforms 12 and 12'.

The left and right connecting rods 14 and 14' have the second ends provided ends rods 141 and 141' which are pivotally connected to the pneumatic cylinders C and C' and the first ends pivotally connected with the left and right transmission members 13 and 13' for restricting the moving length of the left and right connecting rods 14 and 14' and pulling the left and right transmission members 13 and 13' to turn left or right synchronously. The left and right stepping platforms 12 and 12' are turned left or right synchronously along with the user's twirling motion.

FIG. 3 and FIGS. 3-A through 3-D show a second embodiment of the present invention which is substantially similar to the first embodiment with the exceptions described hereinafter. The second embodiment comprises the left and right stepping rods 1 and 1', the left and right transmission members 13 and 13', the left and right connecting rods 14 and 14', and the linking mechanism 2.

The left and right stepping rods 1 and 1' are horizontally connected to two sides of a front section of the machine base 11. The left and right stepping rods 1 and 1' have the left and right through holes 111 and 111' for insertion of the left and right lubricating members 1111 and 1111'. The left and right stepping platforms 12 and 12' are provided with the left and right shafts 121 and 121' inserting through the left and right through holes 111 and 111'.

The left and right transmission members 13 and 13' have the first ends connected with the left and right shafts 121 and 121' and the second ends provided with the eccentric blocks 131 and 131' which are pivotally connected with the first ends of left and right connecting rods 14 and 14', respectively, for controlling the turning direction of the left and right stepping platforms 12 and 12'.

The left and right connecting rods 14 and 14' have the second ends secured to the two sides of the front section of the machine base 11 and the first ends pivotally connected with the left and right transmission members 13 and 13' for restricting the moving length of the left and right connecting rods 14 and 14' and pulling the left and right transmission members 13 and 13' to turn left or right synchronously. The left and right stepping platforms 12 and 12' are turned left or right synchronously along with the user's twirling motion.

Figure 4:
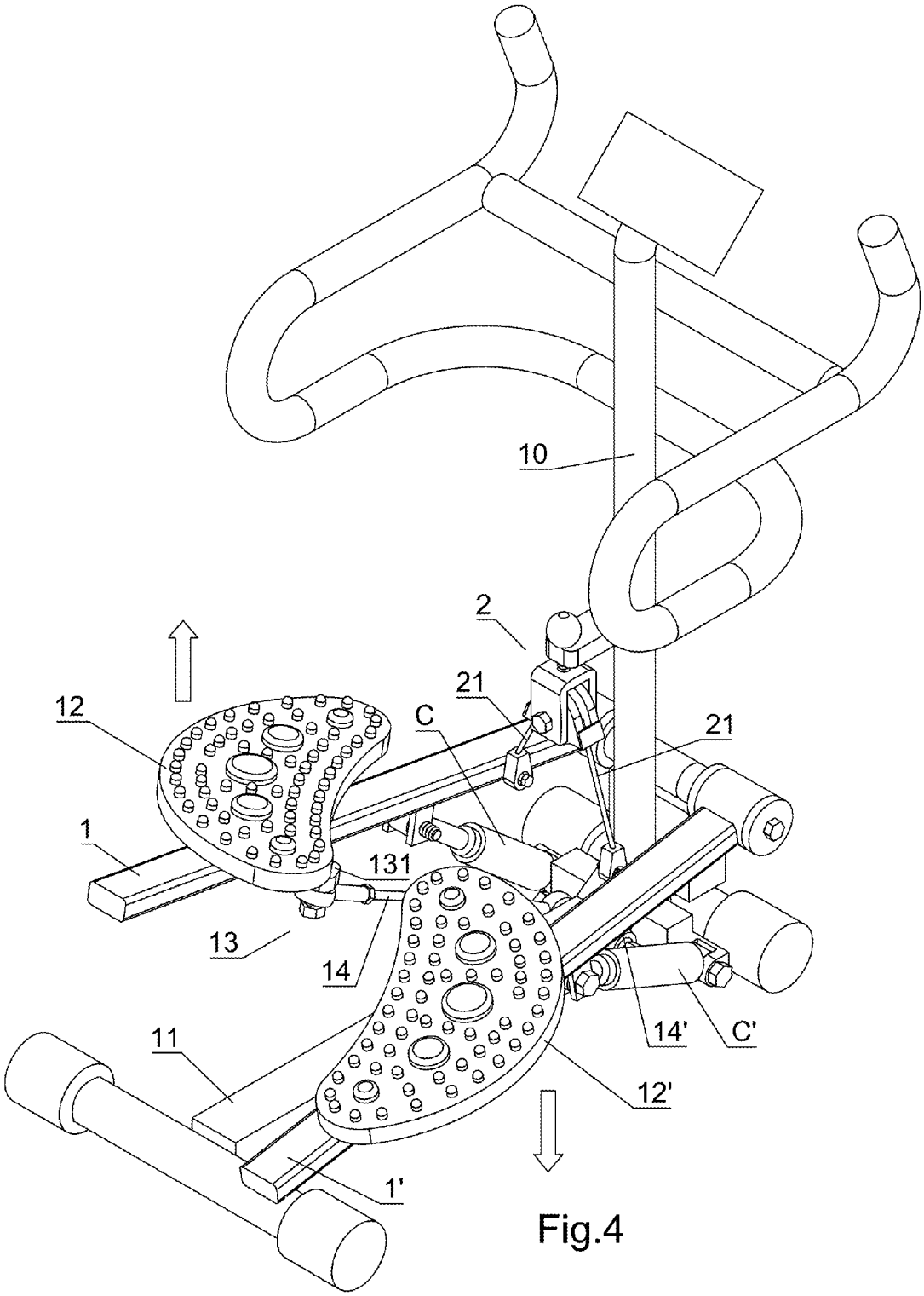
FIG. 4 is a perspective view of the second preferred embodiment of the present invention in an operating status.

As shown in FIG. 2, FIGS. 2-A and 2-B, FIG. 4, FIGS. 4-A and 4-B, a transmission method of a waist twirling exercise machine for body-building of the present invention comprises:

a. left and right stepping platforms 12 and 12' being provided left and right shafts 121 and 121';

b. left and right stepping rods 1 and 1' being formed with through holes 111 and 111';

c. the left and right shafts 121 and 121' of the left and right stepping platforms 12 and 12' being inserted through the through holes 111 and 111' of the left and right stepping rods 1 and 1';

d. the left and right shafts 121 and 121' being secured to first ends of left and right transmission members 13 and 13', the left and right transmission members 13 and 13' having second ends provided with eccentric blocks 131 and 131' which are pivotally connected with first ends of left and right connecting rods 14 and 14', the left and right connecting rods 14 and 14 having second ends pivotally connected to a machine base 11 or pneumatic cylinders C and C'; and e. the left and right stepping platforms 12 and 12' being treaded in turn to bring the left and right stepping rods 1 and 1' to move up and down, the eccentric blocks 131 and 131' of the left and right transmission members 13 and 13' being pushed for controlling the left and right transmission members 13 and 13' to turn at a proper angle.

Therefore, the left and right transmission members 13 and 13' are controlled to turn at a proper angle back and forth so that the left and right stepping platforms 12 and 12' are turned left or right synchronously to provide a waist twirling motion.

Referring to FIGS. 5-A and 5-B in conjunction with FIG. 1-A and FIG. 3-A, the transmission member 13' in FIG. 1-A and FIG. 3-A may be replaced with a transmission member 13". The transmission member 13" is directly fixed to the left and right stepping platforms 12 and 12', respectively. One side of the transmission member 13" is provided with an eccentric block 131 (131') to be connected with the left or right connecting rod 14 (14'). The transmission member 13" is provided with a shat 121 (121') at a lower end thereof to be inserted through the left or right lubricating member 1111 (1111') and the left or right through holes 111 (111') of the left or right stepping rod 11 (11'). When the left and right stepping platforms 12 and 12' are treaded in turn, the left and right transmission members 13 and 13' will be driven to turn at a proper angle by the left and right connecting rods 14 and 14'. The left and right platforms 12 and 12 are turned synchronously at a proper angle back and forth, providing a waist twirling motion for body-building.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A transmission structure of a waist twirling exercise machine for body-building, comprising left and right stepping rods having first ends obliquely connected to two sides of a front end of a machine base, left and right pneumatic cylinders pivotally connected between the left and right stepping rods and the machine base, and a linking mechanism having two ends secured to the left and right stepping rods, the left and right stepping rods compressing the left and right pneumatic cylinders in turn for a damping motion to provide a synchronous stepping and twirling effect, the left and right stepping rods being disposed obliquely for providing left and right swing motions, the transmission structure comprising:

the left and right stepping rods having left and right through holes;

left and right stepping platforms being pivotable on the left and right stepping rods;

left and right transmission members having first ends connected to the left and right stepping platforms and second ends provided with eccentric blocks;

left and right connecting rods having first ends connected to the eccentric blocks of the left and right transmission members and second ends pivotally connected to either of the machine base and the pneumatic cylinders;

thereby, when a user treads on the left and right stepping platforms in turn for providing left and right swing motions, the left and right connecting rods pushing the left and right transmission members, the left and right stepping platforms being driven to synchronously turn left or right at an angle back and forth to orient in substantially the same direction, the swing motions driving the left and right stepping platforms to synchronously turn to orient in substantially the same direction for enhancing a waist twirling effect.

2. The transmission structure of a waist twirling exercise machine for body-building as claimed in claim 1, wherein the left and right through holes of the left and right stepping rods are provided with lubricating members, the lubricating members being either sleeves or bearings.

3. The transmission structure of a waist twirling exercise machine for body-building as claimed in claim 1, wherein the eccentric blocks of the left and right transmission members are universal joints, universal bearings or hinges for connecting with the left and right connecting rods.

4. The transmission structure of a waist twirling exercise machine for body-building as claimed in claim 1, wherein the first ends and the second ends of the left and right connecting rods are universal joints, universal bearings or hinges.

5. The transmission structure of a waist twirling exercise machine for body-building as claimed in claim 1, wherein the left and right transmission members are directly fixed to the left and right stepping platforms, the left and right transmission members being provided with left and right eccentric blocks at a respective side thereof for connecting with the left or right connecting rods, the left and right transmission members being provided with left and right shafts at a respective lower end thereof to be inserted through left and right lubricating members and the left and right through holes of the left and right stepping rods.

6. A transmission structure of a waist twirling exercise machine for body-building, comprising left and right pneumatic cylinders disposed between left and right stepping rods and a machine base and a linking mechanism having two ends secured to the left and right stepping rods, the left and right stepping rods compressing the left and right pneumatic cylinders in turn for a damping motion to provide a mutual synchronous twirling effect, the transmission structure comprising:

the left and right stepping rods having left and right through holes;

left and right stepping platforms being pivotable on the left and right stepping rods;

left and right transmission members having first ends connected to the left and right stepping platforms and second ends provided with eccentric blocks;

left and right connecting rods having first ends connected to the eccentric blocks of the left and right transmission members and second ends pivotally connected to either of the machine base and the pneumatic cylinders;

thereby, when a user treads on the left and right stepping platforms in turn, the left and right connecting rods pushing the left and right transmission members, the left and right stepping platforms being driven to turn left or right at an angle synchronously back and forth to orient in substantially the same direction, treading motions driving the left and right stepping platforms to synchronously turn to orient in substantially the same direction for enhancing a waist twirling effect.

7. The transmission structure of a waist twirling exercise machine for body-building as claimed in claim 6, wherein the left and right through holes of the left and right stepping rods are provided with lubricating members, the lubricating members being either sleeves or bearings.

8. The transmission structure of a waist twirling exercise machine for body-building as claimed in claim 6, wherein the eccentric blocks of the left and right transmission members are universal joints, universal bearings or hinges for connecting with the left and right connecting rods.

9. The transmission structure of a waist twirling exercise machine for body-building as claimed in claim 6, wherein the first ends and the second ends of the left and right connecting rods are universal joints, universal bearings or hinges.

10. The transmission structure of a waist twirling exercise machine for body-building as claimed in claim 6, wherein the left and right transmission members are directly fixed to the left and right stepping platforms, the left and right transmission members being provided with left and right eccentric blocks at a respective side thereof for connecting with the left or right connecting rods, the left and right transmission members being provided with left and right shafts at a respective lower end thereof to be inserted through the left and right lubricating members and the left and right through holes of the left and right stepping rods.

11. A waist twirling exercise machine for body-building, the machine comprising:

left and right stepping rods pivotally connected to two sides of a front end of a machine base, the left and right stepping rods compressing left and right pneumatic cylinders in turn for a damping motion, a. left and right stepping platforms provided with left and right shafts;

b. the left and right stepping rods formed with through holes;

c. the left and right shafts of the left and right stepping platforms inserted through the through holes of the left and right stepping rods;

d. the left and right shafts being secured to first ends of left and right transmission members, the left and right transmission members having second ends provided with eccentric blocks for connecting with first ends of left and right connecting rods, the left and right connecting rods having second ends pivotally connected to the machine base or the left and right pneumatic cylinders;

e. wherein, when the left and right stepping platforms are treaded in turn to bring the left and right stepping rods to move up and down, the eccentric blocks of the left and right transmission members are synchronously pushed for controlling the left and right transmission members to synchronously turn at an angle; and f. wherein the left and right shafts are controlled to turn at an angle synchronously back and forth, the left and right stepping platforms are turned left or right synchronously to orient in substantially the same direction to provide a waist twirling motion.

12. The waist twirling exercise machine for body-building as claimed in claim 11, wherein a connecting means between the first ends of the left and right connecting rods and the left and right transmission members is in the form of universal joints, universal bearings or hinges.

* * * * *